United States Patent [19]

Morgan

[11] 4,279,037

[45] Jul. 21, 1981

[54] ADJUSTABLE HEADGEAR SUSPENSION

[76] Inventor: Frank S. Morgan, 5405 N. 27th Rd., Arlington, Va. 22207

[21] Appl. No.: 81,013

[22] Filed: Oct. 15, 1970

Related U.S. Application Data

[63] Continuation-in-part of Ser. No. 749,800, Aug. 2, 1968, abandoned.

[51] Int. Cl.[3] ..... A42B 7/00

[52] U.S. Cl. ..... 2/421

[58] Field of Search ..... 2/3, 6, 209, 326, 327, 2/328, 7; 24/74, 75, 163, 164, 230 AS

[56] References Cited

U.S. PATENT DOCUMENTS

| | | | |
|---|---|---|---|
| 357,728 | 2/1887 | Munsing | 24/230 AS |
| 1,511,775 | 10/1924 | Rioux et al. | 2/7 UX |
| 2,140,716 | 12/1938 | Pryale | 2/3 R |
| 2,533,526 | 12/1950 | Snyder | 2/3 R |
| 2,867,811 | 1/1959 | Jones | 2/3 R |
| 3,190,973 | 6/1965 | Aileo | 2/3 R X |
| 3,329,968 | 7/1967 | Gordon | 2/3 R |
| 3,596,288 | 8/1971 | Marchello | 2/3 R |

FOREIGN PATENT DOCUMENTS

| | | | |
|---|---|---|---|
| 98620 | 4/1923 | Switzerland | 24/230 AS |

*Primary Examiner*—Werner H. Schroeder

[57] ABSTRACT

An adjustable suspension for protective headgear wherein a constantly uniform tension on all securing members of the suspension can be simultaneously increased or decreased uniformly through a one-step tension control device without removing the headgear from the wearer's head. A chin-strapless embodiment which anchors against vertical displacement on the forehead and skull base. Detachable chin strap with concealed dual locking fastener. A headgear wherein the protective elements are supported by an adjustable, detachable suspension.

13 Claims, 13 Drawing Figures

FIG. 1
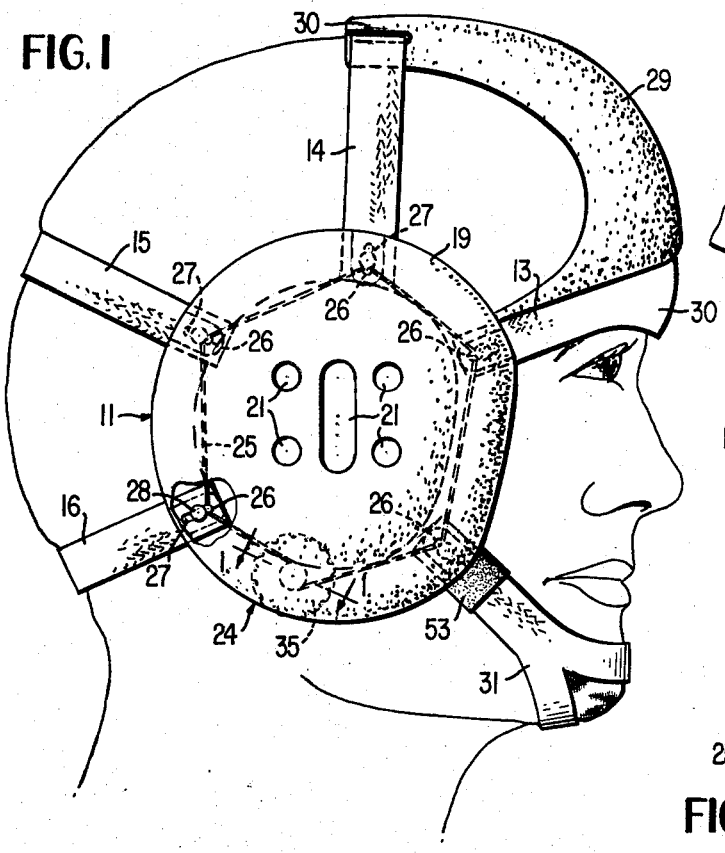
FIG. 2
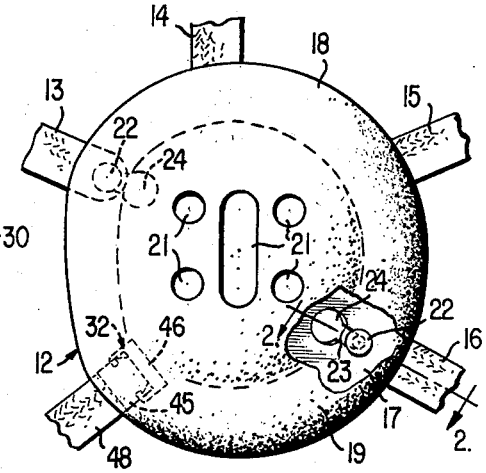
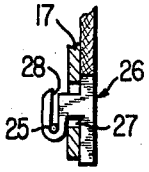
FIG. 5
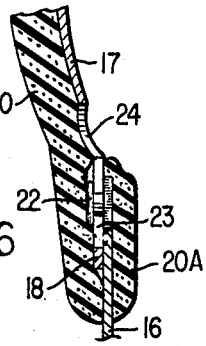
FIG. 6
FIG. 3
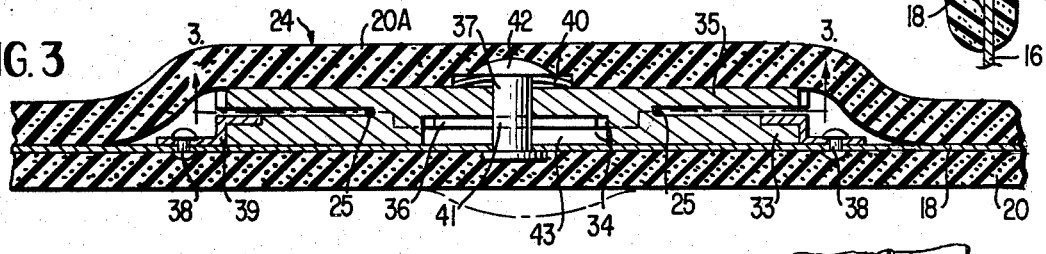
FIG. 4
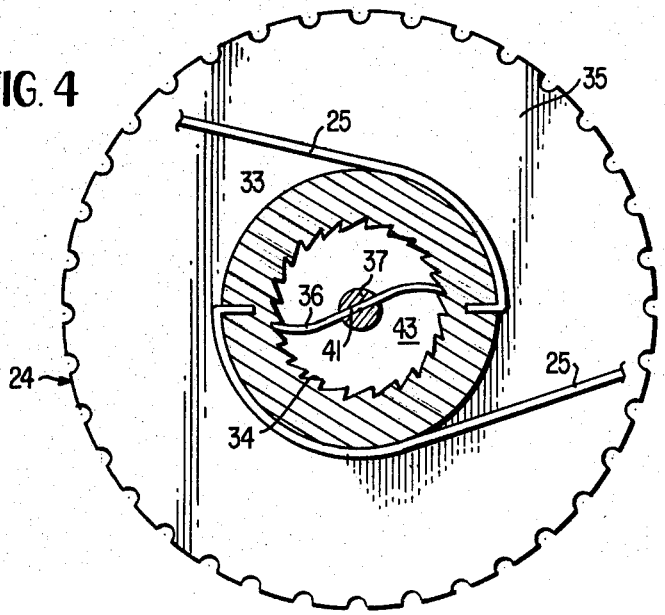
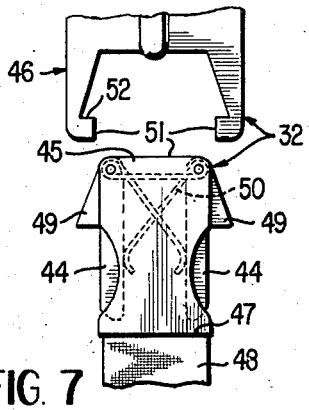
FIG. 7

FIG. 8
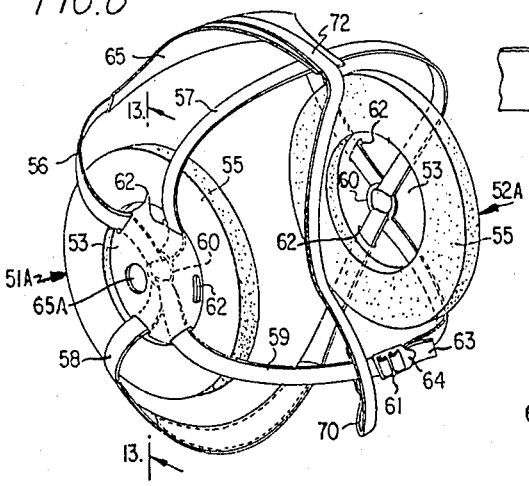
FIG. 12
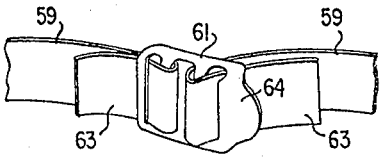
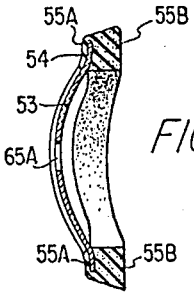
FIG. 13
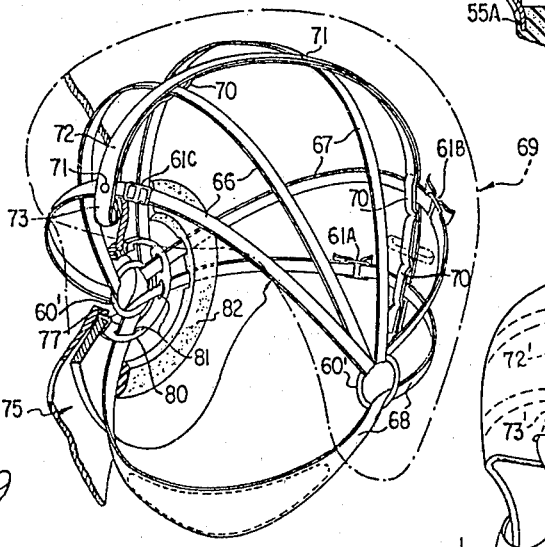
FIG. 9
FIG. 11
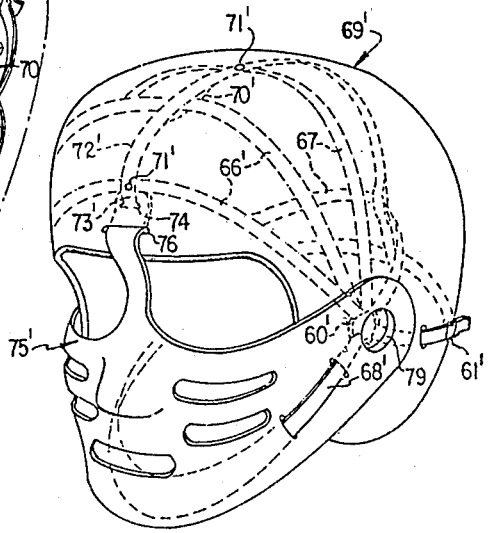
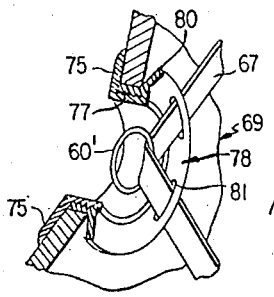
FIG. 10

ADJUSTABLE HEADGEAR SUSPENSION

This application is a continuation-in-part of application Ser. No. 749,800 filed Aug. 2, 1968, now abandoned.

This invention relates to protective headgear of the type worn by athletes, soldiers, firemen, construction workers, factory workers, race drivers, policemen, and other users requiring protection for the head.

Present protective headgears offer various schemes of retaining the protective portion of the headgear in place on the head. Some employ chin straps, which are adjustable, to prevent the headgear from being removed from the head by gravity, wind, or some external blow to the head.

Others provide means for individual adjustment of the retaining straps which hold the protective elements of the headgear in place on the head or over that portion of the head sought to be protected. The present offerings do not, however, provide a means for simultaneous adjustment of all retaining strap members at the same time to a selected uniform tension, nor do they provide a means of simultanous releasing of the selected tension on the retaining straps to permit re-adjustment, placement or removal.

Furthermore, the present offerings do not provide an instantaneous means of uniformly increasing the tension on the retaining strap members while the wearer is engaged in the activity for which the protective headgear is desired without removal of the headgear from the wearer's head. As a result, the protective headgear is permitted to fall from the wearer's head, become displaced so as to hamper the wearer's activity, or even deliberately removed by the wearer himself rather than stop to make the tedious adjustments required to hold the protective headgear in place.

One of the principal objects of the present invention is to provide a novel means for simultaneously adjusting the tension of all of the retaining straps which hold the protective elements of the headgear in the proper position on the head while the headgear is in place.

An additional object of the present invention is to provide a means of quickly releasing the tension on the retaining straps of the protective headgear while the headgear is in place, so as to permit its ready adjustment or removal.

A further object of this invention is to provide a protective headgear which can be held in place without the use of the conventional chin strap, if desired.

A still further object of the present invention is to provide a means of achieving a uniform tension on all retaining straps so as to permit the even distribution of pressure on the wearer's head providing greater comfort as well as dissipation of the impact resulting from a blow to the protective elements of the protective headgear.

Another object of the present invention is to provide a protective guard for the forehead of the wearer which can also be utilized as a background for application of the werer's identification or team insignia.

The foregoing and other objects and advantages of the adjustable protective headgear will become more readily apparent to those skilled in the art from the embodiment thereof shown in the accompanying drawing and from the following description. It is to be understood, however, that such embodiment is shown by way of illustration only and without any intent of limiting the invention to the specific details therein shown.

In the drawings:

FIG. 1 is a perspective view of one form of protective headgear embodying the present invention showing the application of the headgear to a wearer's head.

FIG. 2 is a side elevation of the opposite side of the protective headgear embodiment illustrated with a portion broken away in order to illustrate the method of attaching the head straps.

FIG. 3 is a horizontal sectional view through the adjustment mechanism as shown on the line 1—1 of FIG. 1.

FIG. 4 is a top sectional view through the adjustment mechanism on the line 3—3 of FIG. 3.

FIG. 5 is a cross section view of the slidable cable retainers shown in FIG. 1.

FIG. 6 is a sectional view on an enlarged scale taken substantially on the line 2—2 of FIG. 2.

FIG. 7 is a perspective view of the detachable chin strap fastening mechanism.

FIG. 8 is a three-quarter perspective view of an alternate form of protective headgear embodying the present invention.

FIG. 9 is a three-quarter perspective view, with partial cut-away section of one of the ear protector elements, of a second alternate form of protective headgear embodying the present invention.

FIG. 10 is an enlarged partial cut-away view of one of the ear protector elements which is shown in FIG. 9.

FIG. 11 is a three-quarter view of the outer protective element and face mask portions of the football headgear embodiment of the present invention shown in relation to the adjustable suspension.

FIG. 12 is a perspective view of the tension control mechanism employed in preferred embodiments shown in FIGS. 8, 9 and 11.

FIG. 13 is a cross-section view of the ear protector elements taken along line 13—13 of FIG. 8.

Referring now, in greater detail, to the embodiment of the invention shown in the accompanying drawings, FIGS. 1 and 2, wherein the protective headgear is illustrated in the form of a wrestling headgear, the same is hown to comprise protective elements or ear guards shown generally at 11 and 12, said ear guards differing in construction, however, in that ear guard 11 contains the adjustment mechanism shown in FIGS. 3 and 4, while ear guard 12 does not. The ear guards are connected by a network of retaining bands 13, 14, 15, and 16 which traverse the head of the wearer for positioning and retaining the ear guards thereon in protective relationship to the ears of the wearer. Each ear guard consists of a non-deformable main body shell 17 of concave-convex shape adapted to cover one of the wearer's ears, and with a substantially planar peripheral flange 18.

Each ear guard has a jacket, shown at 19, of flexible, shock absorbing material having a body portion 20 adapted to cover the outer surface of the main body shell 17 and an inwardly extending, circumferentially continuous lip 20A adapted to engage and cover the inner surface of peripheral flange 18. The central portion of main body shell 17 and jacket 19 are provided with registered openings 21 for ventilation and hearing purposes and with slot openings on the latter's peripheral edge through which the head straps 13, 14, 15, 16 and chin strap securing fastener 32 can be inserted for attachment to adjustment cable 25. Ear guard 12 has similar slotted openings through which the opposite ends of said head and chin straps can be inserted for attachment to main body shell 17 as shown in FIG. 2 and described below.

Novel means are provided for connecting non-elastic headstraps 13, 14, 15 and 16 to ear guard 12 in such a manner that the fasteners 22, which are permanently attached to the nonadjustable end of headstraps 13, 14, 15 and 16, can be easily inserted into graduated retaining slots 23 through openings 24 in the main body shell 17, as particularly shown in FIG. 6. Once tension has been placed upon headstraps 13, 14, 15 and 16, fasteners 22 are forced into graduated retaining slots 23 where they are securely held in place by the graduated slots 23, even after the headgear is removed from the wearer's head or during the process of adjustment.

The opposite end of each non-elastic headstrap is attached to connecting cable 25 of the adjustment mechanism 24 through cable engaging hooks 26 which are shown in detail in FIG. 5. Cable engaging hooks 26 are inserted through adjustment slots 27 of main body shell 17 and over tension cable 25 with the open end 28 of each hook facing toward the peripheral edge of main body shell 17. Cable engaging hooks 26 are preferably of the type which have normally closed jaws which spring apart upon forcibly inserting the cable 25 but return to closed position once the cable 25 is within its jaws. Headstrap 13 is engaged to the main body shell 17 of ear guard 11 in the same manner as headstraps 14, 15 and 16. However, headstrap 13 is constructed differently in its central portion, as hereinafter described, and also serves as a base support for forehead protector 29 which is bonded to strap 13 and is held in place at its upper end by headstrap 14, which passes through slot 30 of forehead protector 29.

Headstrap 13 includes central cups 30 which are formed of a semi-rigid material and are eliptically or pocket shaped to fit snugly over the ridge of the wearer's brow to form, with headstrap 16, positioned to rest at the base of the wearer's skull, an anchor against vertical displacement for the entire headstrap assembly. Accordingly, when a uniform tension is placed upon headstraps 13, 14, 15 and 16 through adjustment mechanism 24, headstraps 16 and 13 tend to be pulled in a net downward direction torard the wearer's chin, thus holding the headgear firmly on the head without the use of chin strap 31. The principal advantage of using the brow ridge as the frontal anchor for the headstrap assembly is that it permits the wearer to obtain the maximum air supply at all times through his mouth. This becomes an important factor during the later stages of an intensive physical contest such as a wrestling match, and particularly at higher altitudes.

The forehead protector 29 is of a flexible shock absorbing material and is shaped to conform to the forehead of the wearer so as to provide protection against the effects of blows to the forehead and particularly the danger of butting, which sometimes occurs when both contestants lunge at each other at the same time during a contest.

An optional detachable chin strap 31 is provided as an emergency means of securing the headgear. Its employment, however, is not essential to the effective use of the headgear under normal wearing conditions.

Concealed fasteners, designated generally as 32 in FIG. 7, are of a novel type, which can be readily engaged and disengaged so as to permit removal of the chin strap from the helmet, or to permit removal of the entire helmet from either side, without disturbing the setting of tension adjustment mechanism 24. Concealed fasteners 32 are designed so as to provide a flat surface between the face of the wearer and that of his opponent and is further shielded from both participants by an outer layer of foam rubber 20.

Concealed fastener 32 is comprised of a male head 45 and a female receptacle 46 which is, in this embodiment, permanently attached to cable engaging hook 26 which is slidably mounted on the flange of main body shell 11 and hooked over tension adjustment cable 25.

The male head designated generally as 45 has a substantially rectilinear shaped dual outer shell 47 which is permanently affixed to the end of chin strap 48 by crimping, riveting or other means. Located at the free end of outer shell 47 and between its two flat surfaces, which are spacially separated to accommodate the thickness of chin strap 48, are two pivotally mounted spring catches 49 upon which tension is maintained by spring 50. Female receptacle designated generally as 46 has notched jaws 51 which, upon receiving male head 45, depress spring catches 49 until they have cleared the protruding notches 52 after which they are released to permit their occupation of the full width of the mouth of female receptacle 46 thus locking male head 45 and female receptacle 46 together to form a continuous concealed fastening device, which cannot be disengaged without depressing both spring catches 49 at the same time. Deformable plastic sleeve 53 (FIG. 1) can be slipped over the exposed catch releases 44 of spring catches 49 to prevent their accidental release and to prevent foreign objects from becoming lodged in the mechanism of concealed fastener 32. To disengage male head 45 from female receptacle 46, the wearer need only to slide plastic sleeve 53 down the chin strap 31 until spring catch releases 53 are exposed. By depressing both spring catch releases 44 at the same time, between the wearer's thumb and index finger, buth spring catches 49 are retracted so as to permit the withdrawal of male head 45 from female receptacle 46. Having both ends of the optional chin strap 31 detachable permits the wearer to detach either end depending on whether the wearer is left or right handed, or both ends, whould he desire to wear the headgear without the chin strap. The male portion 45 of concealed fastener 32 on the adjustable ear guard 11, is attached to a female receptacle 46 which is slidably mounted through the main body shell 17, as detailed in FIG. 5, in an integral cable engaging hook 26.

Tension adjustment mechanism, designated generally as 24, and shown in detail in FIGS. 3 and 4, is comprised of tension cable 25, both ends of which are permanently attached to drum 33 which is integral with female ratchet 34 and knurled winding wheel 35. The teeth of female ratchet 34 are adjustably engaged with spring pawl 36 through slidably mounted cylindrical shaft 37 which secures the windlass of adjustment mechanism 24 together, and is rigidly affixed to spring pawl 36 at 41. The adjustment mechanism 24 is in turn affixed to main body shell 17 by rivets 38 through holding bracket 39 and main body shell 17. Cylindrical shaft head 42 is held in tensional relationship to knurled winding wheel 35, drum 33, female ratchet 34 and main body shell 17 by retainer spring 40. Drum 33 has a hollow recess 43 to permit relative movement between the female ratchet 34 and pawl 36 for purposes of disengagement and release of tension on tension cable 25.

The adjustment mechanism 25 can be operated with or without the optional chin strap 31. When the chin strap 31 is used, the wearer first places the headgear as shown in FIG. 1 with the chin strap 31 snapped into place leaving some slack in the headstraps 13, 14, 15 and 16, and chin strap 31. To tighten all of the straps simultaneously and uniformly the wearer with thumb pressure merely rolls knurled winding wheel 35 in a counter-clockwise direction causing tension cable 25 to wind around drum 33 and increasing the tension uniformly on cable engaging hooks 26, which slide axially in adjustment slots 27 toward ventilation and auditory openings 21 thus simultaneously and uniformly increasing the tension on headstraps 13, 14, 15 and 16, as well as on chin strap 31 to the desired amount. When chin strap 31 is not used, the tension is evenly distributed among headstraps 13, 14, 15 and 16 to effectively hold the ear and forehead protectors firmly in place.

The tension selected by the wearer, as described above, is retained by spring pawl 36 which engages the nearest tooth in ratchet 34 to prevent the knurled winding wheel 35 from returning to its original position in response to the increased tension on cable 25 and the headstraps 13, 14, 15 and 16.

To release the tension on the headstraps, the wearer presses the rounded head 42 of cylindrical shaft 37 until retainer spring 40 is depressed and pawl 36 is forced into hollow recess 43, thus disengaging pawl 36 from the teeth of female ratchet 34 allowing spring pawl 36 to turn clockwise until all tension on tension cable 25 is released. To remove the helmet, it is only necessary to release one of the male fasteners 45 of the chin strap and lift the helmet off the head.

The capability of fast and uniform tension adjustment permits one headgear to be readily passed from one wearer to the next without delaying the wrestling match and with little time lost in fitting the head size of the next wearer.

Referring to the second embodiment of the invention shown in FIG. 8 of the drawings wherein the adjustable suspension is also illustrated in the form of a wrestling headgear, the same is shown to comprise two ear protector elements shown generally at 51 and 52 and being of identical construction. Ear protector elements 51 and 52 are connected by a network of retaining head straps 56 and 57, chin-strap 58 and nape strap 59 all of which radiate, at corresponding intervals, from ear protector elements 51 and 52 and traverse the head and chin of the wearer. Their function is to position and retain ear protector elements 51 and 52 in protective relationship to the ears of the wearer. Retaining straps 56, 57, 58 and 59 are made of substantially non-elastic webbing to provide firm support for ear protector elements 51 and 52. Each radial strap threads through tension equalizing bearing 60 and is free to slide through its own radial slot 62 so as to respond to changes in tension exerted on any one of the radial straps. Each radial strap is positioned so as to provide a substantially opposing force on tension equalizing bearing 60 to its opposite number. The free ends of tension strap 57 are suitably joined together to form a junction with crown guide and sizing strap 72. The free ends of nape strap 59 are held together by an adjustable double buckle 61, detailed in FIG. 12. Crown strap 72 serves to position head straps 56 and 57, as support for butting and hair retainer pad 65, and to provide an adjustable anchor against vertical displacement for nape strap 59 which is threaded through one of the sizing slots 70 located at the tail end of crown strap 72. The wearer will select the appropriate sizing slot which permits nape strap 59 to come to rest at the base of the wearer's skull when desired tension is applied to the suspension in place on his head.

Ear protector elements 51 and 52 consist of a non-deformable shell 53 of concave-convex shape adapted to cover one of the wearer's ears, and with a substantially planar peripheral flange 54 as shown in FIG. 13. Each non-deformable shell has a jacket, shown at 55, FIG. 13, of flexible shock absorbing material having a circumerentially continuous outer body portion 55A adapted to cover the outer surface of peripheral flange 54 and an inwardly extending circumferentially continuous body portion 55B adapted to engage and cover the inner surface of peripheral flange 54. The central uncovered portion of nondeformable shells 53 are provided with circular openings 65A for ventilation and hearing purposes and with radial slot openings 62 on their peripheral edges through which retaining straps 56, 57, 58 and 59 can be inserted for engagement with tension equalizing bearing 60.

Tension equalizing bearing 60 floats freely between radial slot openings 62 permitting continuous equalization of stresses between retaining strap pairs 56 and 57 and chin and nape straps 58 and 59. Tension is increased or decreased uniformly on all retaining straps by merely shortening or lengthening nape strap 59. Nape strap 59 can be shortened by pulling in opposite directions on strap ends 63, FIG. 12. Tension on all retaining straps can be simultaneously and uniformly reduced by moving tab 64 of adjustment buckle 61 to a position perpendicular to the long axis of nape strap 59. This permits the release of strap end 63 nearest tab 64 thereby reducing the tension of all radial straps through tension equalizing bearing 60. Thus in a one-step adjustment procedure the tension on all retaining straps 56, 57, 58 and 59 can be increased or decreased as described above.

FIGS. 9, 10 and 11 illustrate a further embodiment of the invention as it applies to a football headgear. Tension equalizing bearing 60 acts as a floating central guide bearing through which head retaining straps 66 and 67 and chin and nape strap 68 are threaded to form an adjustable suspension for the head protector element shown generally as 69. Head retaining straps 66 and 67 and the nape strap portion of retaining strap 68 are positioned relative to one another by loops 70 and snaps 71 of crown strap 72. In FIG. 11, crown strap 72 is anchored to head protector element 69 through end loop 73 of crown strap 72. End loop 73 engages with slot 74 of the nose guard portion of face mask 75. Face mask 75 is first inserted through slot 76 of head protector element 69 then crown strap 72 is threaded through slot 74 and joined to head strap 66 by snap 71.

Face mask 75 is also anchored to head protector element 69 by interlocking with threads 77, FIG. 10, of guide bearing 78 positioned at the hearing openings 79, FIG. 11, of head protector element 69. Guide bearings 78 are provided with a dish-shaped peripheral flange 80 and with radial slots 81 which serve as guides for retaining straps 66, 67 and 68 and to provide a flexible connection between the suspension system and head protector element 69. Head protector element 69 is also supported in protective relationship to the wearer's head by ear cushions 82 and other shock absorbent cushions positioned at the forehead, crown and nape of the wearer's neck, not shown.

Tension equalizing bearing 60 floats freely between radial slot openings 81 thus automatically achieving continuous equalization of stresses between retaining strap pairs 66, 67 and 68. By shortening retaining nape strap 68, FIG. 9, by pulling on either of strap ends 63, FIG. 12, a uniform increase in tension of the desired amount is achieved between retaining strap pairs 66, 67 and 68. To decrease tension to the desired amount tab 64, FIG. 12, of adjustment buckle 61 is raised with the thumb of the wearer to a position perpendicular to the long axis of nape strap 59. Adjustment buckle 61, FIG. 11, is conveniently located outside of head protector element 69 to enable the wearer to quickly adjust the tension on his headear without delaying the game.

Although three specific embodiments of protective headgear have been described and illustrated in the accompanying drawings, it will be obvious that the invention is not limited to the exact embodiments shown, but is capable of embodiment in various structural forms and other types of head protection equipment. Various changes in structure will no doubt occur to those skilled in the art, and will be understood as forming a part of my invention; insofar as they fall within the spirit and scope of the appended claims.

The invention is claimed as follows:

1. In an adjustable headgear suspension comprising, head protective means, securing means coupled to said protective means for engaging the wearer's head and securing said head protective means in protective relationship to the wearer's head, said securing means comprising, a flexible-inextensible eyebrow-engaging head strap means adapted to engage and utilize the wearer's eyebrows as an anchor against vertical displacement when tension is applied to any member of the said securing means, a flexible-inextensible rear head-engaging strap positioned to utilize the depression at the base of the wearer's skull as an anchor against vertical displacement when tension is applied to any member of said securing means, and at least one flexible-inextensible head strap passing meridionally around the top of the wearer's head and positioned at substantially equal intervals between the said eyebrow-engaging head strap means and said rear head-engaging strap, universal tension equalizing means associated with at least one of said head protective means, said universal equalizing means being coupled to said securing means and adapted to simultaneously uniformly vary the tension on said securing means to achieve and automatically maintain uniform tension on said securing means.

2. The adjustable headgear as defined in claim 1 wherein, said securing means includes a detachable chin-strap having two spring-actuated securing catches at one end thereof adapted to be detachably connected to one of said head protective elements;

said detachable chin strap when attached being coordinately and simultaneously adjustable to the same uniform tension as the other securing means through the said universal tension equalizing means.

3. An adjustable protective headgear as defined in claim 2 wherein the said two spring-actuated securing catches comprise;

a male engaging head secured to one end of said detachable chin-strap, said male engaging head having two pivotally-mounted catches spring actuated on opposit directions away from the center of said male engaging head, a female engaging receptacle located on one of said head protective means and adapted to receive the male engaging head when said two pivotally mounted catches are depressed toward each other to permit passage into said female engaging receptacle, said male engaging head and female engaging receptacle adapted to lock together when said male engaging head is received into said female engaging receptacle, said male and female engaging means being adapted so as to permit disengagement only when both spring-actuated securing catches of the male engaging head are simultaneously depressed toward the center of said male engaging head by pressure upon both spring actuated securing catches simultaneously and from opposite directions.

4. An adjustable protective headgear as defined in claim 1 wherein the said head protective means includes at least one head protector pad adapted to conform to the wearer's head and positioned between at least two components of said securing means;

means attaching said head protector pad to said securing means, said two components of said securing means maintaining said head protector pad in protective position on the wearer's head, one of said head protector pads being adapted to receive and retain identifying insignia on the forehead of the wearer.

5. In an adjustable headgear suspension comprising, at least one head protective element supported by unsupported means for securing said head protective element in protective relationship to the wearer's head, said unsupported means comprising at least three radially arranged substantially equally spaced flexible-inextensible head suspension straps, with one of said straps being a detachable chin-strap positioned and adapted to receive the wearers chin and for locking the headgear in place on the wearer's head, universal tension equalizing means associated with at least one of said head protective elements slidably interconnecting said strap means in a manner which provides uniform omnidirectional flexible-inextensible resistance to displacement of said at least one head protective element relative to the wearer's head in response to varying externally applied forces, single step adjustment means coupled to said unsupported means and said universal tension equalizing means adapted to simultaneously uniformly vary the tension on each of said at least three radially arranged head suspension straps to achieve and automatically maintain uniform omnidirectional resistance to displacement of said at least one head protective element relative to the wearer's head in response to varying externally applied forces.

6. An adjustable headgear suspension as defined in claim 5 wherein said adjustment means comprises, fastening means frictionally engaging one end of one of said at least three radially arranged substantially equally spaced flexible-inextensible head suspension straps and frictionally engaging the other end of said one of said straps and adapted to infinitely increase or decrease the magnitude of said uniform omnidirectional flexible-inextensible resistance to displacement and to automatically maintain said uniform omnidirectional resistance to displacement of said protective element once adjustment has been accomplished.

7. An adjustable headgear suspension as defined in claim 5 in which said at least one head protective element includes a forehead protector pad shaped to conform to the wearer's head and positioned between and connected to at least two of said at least three flexible-inextensible radially-arranged head suspension straps maintaining said forehead protector pad in protective relationship to the wearer's head.

8. In a detachable chin-strap for an adjustable headgear suspension the combination comprising:

an elongated flexible-inextensible flat strap whose opposite ends are adapted to be detachably secured to the opposite sides of a protective headgear and having a central portion adapted to receive the wearer's chin;

a catch at one end thereof comprising a pair of male elements;

spring means for urging said male elements in opposite directions;

means on opposite sides of said catch coupled to said male elements and said spring means for simultaneously urging said male elements towards each other when pressure is simultaneously externally applied thereto from opposite directions;

one side of the said protective headgear having a female engaging receptacle attached thereto and positioned in a recessed protected relationship to the said one side of the said protective headgear to prevent accidental contact with said female engaging receptacle which could cause unintentional disengagement of the male dual spring fastener from the female engaging receptacle, said female engaging receptacle adapted for receiving and interlocking with said pair of male elements and adapted to be disengaged from said pair of male elements only when both male elements are simultaneously urged toward each other by pressures applied from opposite directions.

9. A protective headgear comprising, a head protective shell including two ear guard elements correspondingly positioned at opposite poles on a common axis running between the wearer's ears, said shell providing at least one open crown opening, said shell having slot openings therein adapted to weavingly slidably receive flat web suspension straps, securing means coupled to said head protective shell for engaging the head and supportively interconnecting said two ear guard elements to flexibly-inextensibly hold them in protective relationship to the wearer's head, said securing means comprising at least two adjustable radially-arranged flexible-inextensible lune-shaped self-equalizing strap-loop systems adapted and arranged to distribute the total tensional force applied to said securing means among the said at least two strap-loop systems in proportion to the resultant tensional force exerted by each strap-loop system upon the said two ear guard elements when the headgear is secured to the wearer's head, said securing means being slidably interconnected with said head protective shell by said securing means being woven through said slot openings in said shell in a manner adapted to secure shock absorbent head protector elements in protective relationship to the wearer's head, universal tension equalizing means weavingly detachably coupled to at least one side of said shell and slidably interconnecting said at least two loop-strap systems, said universal tension equalizing means so adapted and arranged to provide uniform omnidirectional resistance to displacement of said shell and said head protective elements relative to the wearer's head, infinitely adjustable single-step adjustment means coupled to said securing means and adapted to simultaneously uniformly vary the total tensional force applied to said securing means without changing the proportional distribution of the said total tensional force among the said self-equalizing strap-loop systems comprising the said securing means, said adjustment means being adapted to vary the total tension on said securing means while the headgear is locked in place on the wearer's head.

10. In a protective headgear comprising, head protective means including two ear guard elements correspondingly positioned at opposite poles on a common axis running between the wearer's ears;

securing means coupled to said head protective means for engaging the head and supportively interconnecting said two ear guard elements to flexibly-inextensibly hold them in protective relationship to the wearer's head;

said securing means comprising at least three flexible-inextensible substantially equally spaced head-engaging support straps so adapted and radially-arranged about the said axis running between the wearer's ears at radial intervals of less than 180 degrees measured at the axial angle between any two adjacent head-engaging support straps so that each of said at least three head-engaging support straps provides an equilibrant tensional force upon each ear guard element and opposite to the resultant force of the combined tensional forces exerted by the other opposing head engaging support straps upon each ear guard element whereby both of said two ear guard elements are held in equilibrium over the wearer's ears;

universal tension equalizing means associated with at least one of said two ear guard elements and slidably connected to said securing means for simultaneously producing and automatically maintaining uniform tension on all radially-arranged head-engaging support straps whereby continuous uniform omnidirectional flexible-inextensible resistance to displacement, relative to the wearer's head, is exerted upon said two ear guard elements and said head protective means;

single-step adjustment means coupled to said securing means and said universal tension equalizing means adapted for simuntaneously uniformly varying the tension on all radially-arranged head-engaging support straps.

11. The protective headgear as defined in claim 10 wherein one of said at least three radially-arranged head engaging support straps is a detachable chin-strap adapted to engage the point of the wearer's chin for thereby locking the headgear in place on the head, said chin strap being coordinately and simultaneously adjustable to the same tension as the other radially arranged head-engaging support straps when the headgear is locked in place on the head.

12. A protective headgear is defined in claim 9 including a protective face mask shaped to conform to the wearer's face and permitting full peripheral vision for the wearer, said face mask being detachably weavingly secured to said protective headgear in a manner adapted to secure shock absorbent face protector elements in protective relationship to the wearer's face.

13. The protective headgear as defined in claim 11, wherein the said detachable chin strap has two spring-actuated securing catches at one end thereof adapted to be detachably connected to at least one portion of the said head protective means in a manner so as to be disengaged only when both of said securing catches are simultaneously urged toward each other from opposite directions.

* * * * *